US009631322B2

(12) United States Patent
Luu et al.

(10) Patent No.: US 9,631,322 B2
(45) Date of Patent: Apr. 25, 2017

(54) METHOD OF APPLYING FUGITIVE HYDROPHOBIC TREATMENT TO TISSUE PRODUCT

(71) Applicant: GEORGIA-PACIFIC CONSUMER PRODUCTS LP, Atlanta, GA (US)

(72) Inventors: Phuong Van Luu, Ellenton, FL (US); Steven L. Edwards, Fremont, WI (US); David W. White, Clintonville, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 14/851,568

(22) Filed: Sep. 11, 2015

(65) Prior Publication Data

US 2016/0002860 A1 Jan. 7, 2016

Related U.S. Application Data

(63) Continuation of application No. 13/279,799, filed on Oct. 24, 2011, now abandoned.

(Continued)

(51) Int. Cl.

| | |
|---|---|
| ***B05D 3/02*** | (2006.01) |
| ***D21H 27/00*** | (2006.01) |
| ***D21H 17/06*** | (2006.01) |
| ***D21H 17/17*** | (2006.01) |
| ***D21H 17/53*** | (2006.01) |
| ***D21H 17/55*** | (2006.01) |
| ***D21H 17/59*** | (2006.01) |
| ***D21H 17/60*** | (2006.01) |
| ***D21H 19/20*** | (2006.01) |

(Continued)

(52) U.S. Cl.

CPC ..... *D21H 27/007* (2013.01); *D21H 11/00* (2013.01); *D21H 17/06* (2013.01); *D21H 17/17* (2013.01); *D21H 17/53* (2013.01); *D21H 17/55* (2013.01); *D21H 17/59* (2013.01); *D21H 17/60* (2013.01); *D21H 19/20* (2013.01); *D21H 19/32* (2013.01); *D21H 21/16* (2013.01); *D21H 27/002* (2013.01)

(58) Field of Classification Search

CPC ..... D21H 17/06; D21H 17/17; D21H 17/53; D21H 17/55; D21H 17/59; D21H 27/007; D21H 19/20; D21H 19/32; D21H 21/16; D21H 27/002; D21H 11/00; D21H 17/60

See application file for complete search history.

(56) References Cited

U.S. PATENT DOCUMENTS

| | | |
|---|---|---|
| 3,362,965 A | 1/1968 | England, et al. |
| 4,040,900 A | 8/1977 | Mazzarella et al. |

(Continued)

FOREIGN PATENT DOCUMENTS

| | | |
|---|---|---|
| EP | 0144658 | 6/1985 |
| EP | 0432838 | 6/1991 |
| EP | 02081587 | 10/2002 |

OTHER PUBLICATIONS

International Search Report and Written Opinion of the International Searching Authority for PCT/US2011/057620 dated Feb. 3, 2012.

(Continued)

*Primary Examiner* — Robert S Walters, Jr.

(74) *Attorney, Agent, or Firm* — Laura L. Bozek

(57) ABSTRACT

Cellulosic tissue sheets having temporary moisture barrier properties are prepared by applying a solution of reactive size in emollient at an elevated temperature to a previously formed tissue sheet.

22 Claims, 1 Drawing Sheet

Related U.S. Application Data

(60) Provisional application No. 61/456,126, filed on Nov. 1, 2010.

(51) Int. Cl.

| | |
|---|---|
| ***D21H 19/32*** | (2006.01) |
| ***D21H 21/16*** | (2006.01) |
| ***D21H 11/00*** | (2006.01) |

(56) References Cited

U.S. PATENT DOCUMENTS

| | | | |
|---|---|---|---|
| 4,349,610 | A | 9/1982 | Parker |
| 4,362,781 | A | 12/1982 | Anderson |
| 4,755,421 | A | 7/1988 | Manning et al. |
| 5,071,675 | A | 12/1991 | Gupta et al. |
| 5,246,545 | A | 9/1993 | Ampulski et al. |
| 5,252,754 | A | 10/1993 | Bottorff |
| 5,256,417 | A | 10/1993 | Koltisko |
| 5,300,358 | A | 4/1994 | Evers |
| 5,308,441 | A | 5/1994 | Kern |
| 5,630,972 | A | 5/1997 | Patnode et al. |
| 5,714,266 | A | 2/1998 | Harrison et al. |
| 6,054,020 | A | 4/2000 | Goulet et al. |
| 6,087,550 | A | 7/2000 | Anderson-Fischer et al. |
| 6,126,784 | A | 10/2000 | Ficke et al. |
| 6,165,320 | A | 12/2000 | Bates et al. |
| 6,238,519 | B1 | 5/2001 | Jones et al. |
| 6,332,952 | B1 | 12/2001 | Hsu et al. |
| 6,458,243 | B1 | 10/2002 | Jones et al. |
| 6,464,829 | B1 | 10/2002 | Chen et al. |
| 6,468,392 | B2 | 10/2002 | Oriarian et al. |
| 6,485,555 | B1 | 11/2002 | Lindgren et al. |
| 6,573,203 | B1 | 6/2003 | McConnell et al. |
| 6,649,024 | B2 | 11/2003 | Oriarian et al. |
| 6,755,939 | B2 | 6/2004 | Vinson et al. |
| 6,818,101 | B2 | 11/2004 | Vinson et al. |
| 7,045,036 | B2 | 5/2006 | Lipponen et al. |
| 7,276,459 | B1 | 10/2007 | Lang et al. |
| 7,300,547 | B2 | 11/2007 | Luu et al. |
| 7,592,049 | B2 | 9/2009 | Jones et al. |
| 7,605,096 | B2 | 10/2009 | Tomarchio et al. |
| 7,666,448 | B2 | 2/2010 | Mower |
| 7,772,138 | B2 | 8/2010 | Lostocco et al. |
| 7,776,772 | B2 | 8/2010 | Barnholtz et al. |
| 7,799,169 | B2 | 9/2010 | Bhat et al. |
| 7,846,296 | B2 | 12/2010 | Luu et al. |
| 8,025,764 | B2 | 9/2011 | Bhat et al. |
| 2003/0201085 | A1 | 10/2003 | Vinson et al. |
| 2006/0254736 | A1 | 11/2006 | Jackson et al. |
| 2007/0107865 | A1 | 5/2007 | Tammi et al. |
| 2009/0218058 | A1 | 9/2009 | Manifold et al. |
| 2010/0116451 | A1 | 5/2010 | Bhat et al. |
| 2010/0239843 | A1 | 9/2010 | Luu et al. |

OTHER PUBLICATIONS

Bottorff, "AKD Sizing Mechanism: A More Definitive Description", Tappi Journal, Apr. 1994, vol. 77, No. 4, 105-116.

Isogai, "Mechanism of Paper Sizing by Alkylketene Dimers", Journal of Pulp and Paper Science, Jul. 1999, vol. 25 No. 7, 251-255.

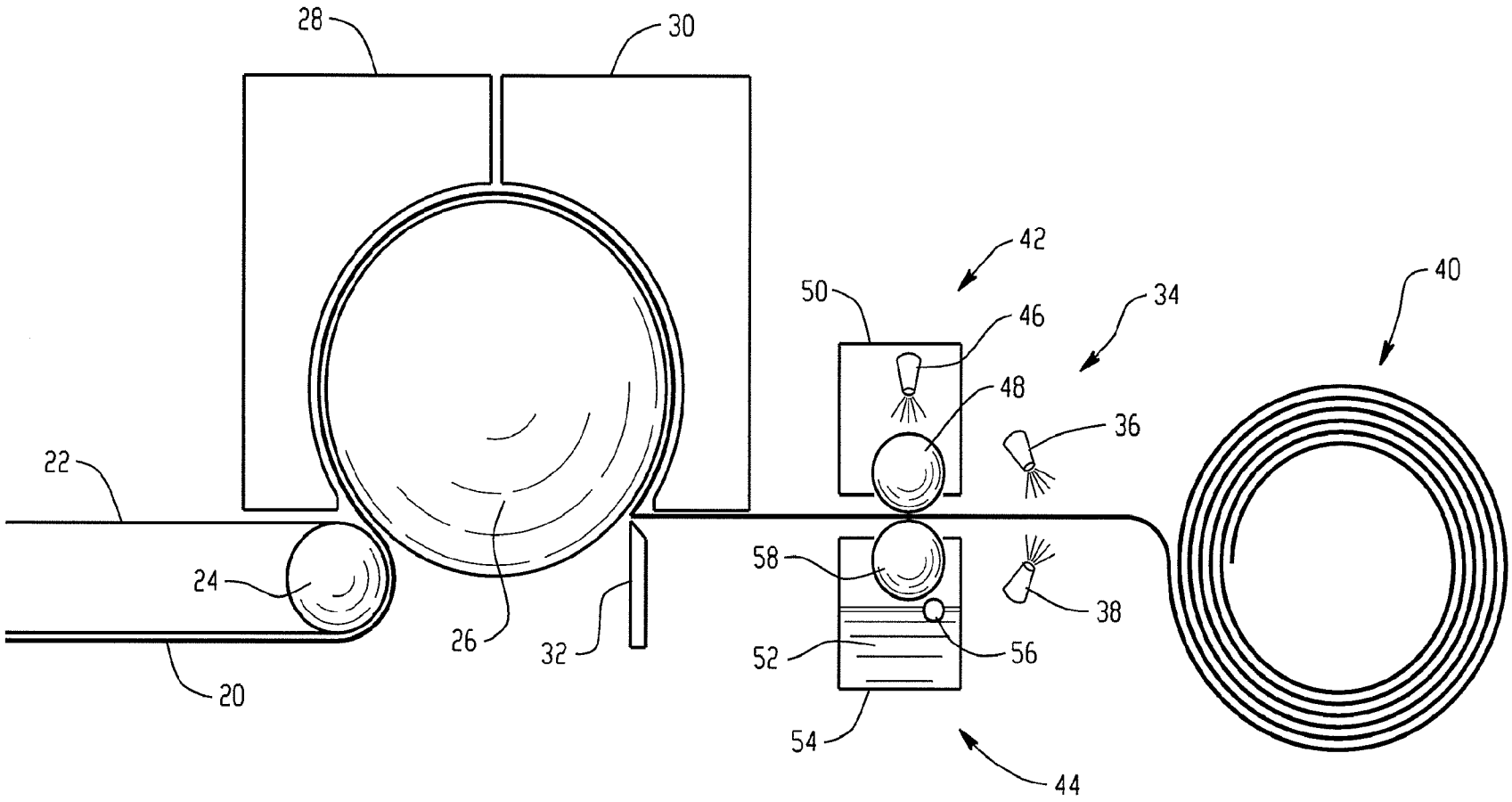
40
34
36
38
42
46
48
56
44
50
58
52
54
30
32
26
28
24
20
22

METHOD OF APPLYING FUGITIVE HYDROPHOBIC TREATMENT TO TISSUE PRODUCT

CLAIM FOR PRIORITY

This non-provisional application is a continuation of U.S. application Ser. No. 13/279,799, filed Oct. 24, 2011, which is based upon U.S. Provisional Patent Application No. 61/456,126, of the same title, filed Nov. 1, 2010. The priority of U.S. application Ser. No. 13/279,799 and U.S. Provisional Patent Application No. 61/456,126 is hereby claimed and the disclosure thereof is incorporated into this application by reference.

BACKGROUND OF THE INVENTION

Tissue products must reconcile many competing qualities; they must be strong yet soft, absorbent yet protective, and above all, they must be inexpensive. This invention relates to a method of making tissue products more protective without adding inordinately to the cost while retaining the ability for the sheets to be flushed or repulped as well as the resulting tissue. Many methods of imparting barrier properties to tissue products involve adding a sizing agent to the furnish, or some part of the furnish, before the sheet is formed and result in permanent hydrophobicity which often makes flushing problematic and repulping impractical. Further, wet end addition usually implies that sizing must be applied over the entire area of the sheet of tissue and may impose limitations on the other additives that can be incorporated into the furnish. In approaches where the sizing agent is applied after the sheet is formed, additional drying may be required in many cases, which may either add greatly to the cost or be completely impractical depending on the manufacturing facilities available. Further, addition of even relatively small amounts of water to a previously formed tissue sheet can greatly detract from desirable properties that the tissue maker has gone to great lengths to incorporate into the sheet—particularly bulk and softness.

Some of the most potent sizing agents for papers are reactive sizes. These are extremely efficient and have become very widely used, at least for flat papers and paperboards. While there have been many methods proposed for using reactive sizes as an internal size for tissue products, use as external size has been hampered by the difficulty involved in getting the reactive agents onto the sheet without seriously detracting from the structure of the tissue as well as potential difficulty with flushing or repulping the resulting sheet. In the typical case, heat is applied after the reactive size has been applied to ensure that they accomplish exactly what is implied by "reactive size"—to react with the sheet, typically by opening the β-lactone ring followed by esterification in the case of alkenyl ketene dimers or, in the case of alkenyl succinic anhydrides, by ring opening of the anhydride ring also followed by esterification. However, in almost all cases, after reactive sizes are applied either as emulsions or by incorporation in the wet end, heat is applied to open the ring structure and drive the esterification reaction to completion imparting permanent barrier properties to the treated sheet and thereby potentially interfering with repulpability and flushability.

Accordingly, it can be appreciated that there has been a need for towel and tissue products having barrier properties but retaining flushability and repulpability with premium grade softness that could be easily manufactured on existing manufacturing assets.

McConnell et al., U.S. Pat. No. 6,573,203, discloses:

> . . . a towel desirably including first and second layers having cellulosic fibers and a repellant agent. The first and second layers may substantially sandwich a third layer having cellulosic fibers with higher absorbency than the first and second layers. All three layers may form a single ply.
>
> Furthermore, the towel may also include fourth and fifth layers positioned between, respectively, the first and third layers and the second and third layers. The fourth and fifth layers may have cellulosic fibers with higher wicking than the first and second layers.
>
> In addition, the repellant agent may be wax, latex, a sizing agent, and/or silicon. Moreover, the repellant agent may be printed and/or sprayed onto at least one of the first or second layers. Furthermore, the repellant agent may be mixed with the fibers of at least one of the first or second layers in a headbox. What is more, the first or second layers may include sulfite pulp or BCTMP and the towel may have a basis weight from about 8 gsm to about 59 gsm. [col. 3, 11. 8-26]
>
> . . . Repellant agents may include waxes, latexes, silicon, and sizing agents. [col. 4, 11. 33-34.]
>
> . . . Particularly suitable sizing agents are acid or alkaline sizes such as acid rosin, alkenyl succinic anhydride, alkyl ketone dimers and alkenol ketene dimers . . . [col. 2, 11. 5-7]

Hsu et al., U.S. Pat. No. 6,332,952, discloses a tissue having at least one ply with a region that prevents fluid from striking through the tissue product stating that:

> Furthermore, at least one ply may be treated with a repellant agent to create a region for preventing fluid strikethrough. Moreover, at least one ply may be printed and/or sprayed with a repellant agent. In addition, the repellant agent may be a sizing agent or hydrophobic chemical.
>
> Another embodiment of a toilet tissue product may include a first cellulosic ply further having a first layer and a second layer and a second cellulosic ply further having a first layer and a second layer. The first layers of the plies may substantially sandwich the second layers of the plies, where at least one of the second layers may be resistant to fluid strikethrough. In addition, at least one of the second layers may include a repellant agent.
>
> Moreover, the repellant agent may be a wax, latex, hydrophobic chemical and/or sizing agent. Furthermore, the repellant agent may be printed onto at least one of the second layers. Additionally, the repellant agent may be sprayed onto at least one of the second layers. Also, the repellant agent may be mixed in with the fibers of at least one of the second layers in a headbox. Further, at least one of the second layers may include sulfite pulp or BCTMP. [col. 3, 11. 33-54]
>
> Particularly suitable sizing agents are acid or alkaline sizes such as acid rosin, alkenyl succinic anhydride, alkyl ketone dimers and alkenol ketene dimers . . . [col. 2, 11. 29-32]
>
> . . . A repellant agent, such as a sizing agent, may be applied to the dry web by spraying an aqueous solution through the spray boom 148 located between the blade 144 and the core 152. Alternatively, the repellant agent may be sprayed or coated onto the moving tissue web prior to the pressure roll 130 or after the tissue web has transferred to the Yankee dryer 136. [Col. 6, 11. 57-63]

A variety fluorinated AKD and ASA derivatives have been used as sizes to impart resistance to both oil and water. Bottorff; U.S. Pat. No. 5,252,754, suggests the use of a:

. . . class of sizing composition . . . referred to as fluorinated alkyl ketene dimer dispersions/emulsions and represented for convenience by the abbreviation $R_f$AKD. The invention particularly contemplates their use to impart water, hot-water, oil, and hot oil resistance to biodegradable cellulose molded articles, thus providing an alternative to non-biodegradable polystyrene. [col. 4, 11. 34-41]

Bottorff further teaches that:

The aqueous $R_f$AKD dispersions/emulsions are very stable. Outstanding oil, grease and water resistant paper can be achieved by convenient, direct addition of the $R_f$AKD dispersions/emulsions to the pulp slurry as the paper is being made or by surface application after the paper is formed. The $R_f$AKD can also be surface applied to preformed paper from an organic solvent solution. They are not precipitated by cations from hard water, unlike the anionic salts contained in commercial oil-sizing agents, and the use of water softening agents is avoided.

The $R_f$AKD sizing agents of the invention form covalent bonds to cellulose fibers under conditions existing on commercial paper machines using the heat from the paper machine, and thus avoid disruption of the bonding by acidic, basic, or neutral aqueous penetrants. [col. 6, 11. 7-22]

Harrison et al., U.S. Pat. No. 5,714,266, suggests use of:

. . . a composition for treating pulp slurry in the wet end comprising (A) a mixture of fluoroaliphatic radical-containing phosphate esters comprising at least 70% of phosphate monoesters, e.g.

$C_8F_{17}S0_2N(C_2H_5)C_2H_40P(0)$ (OH) ($0^-NH_4^+$) and (B) an alkyl ketene dimer, e.g. Hercon™ 76 from Hercules. Preferably, said mixture of esters comprises greater than 90% of said monoester.

Harrison et al. further suggests use of:

. . . a method for preparing treated paper and paperboard products comprising (1) treating pulp slurry in the wet end with the composition of this invention. and (2) curing this treated slurry using low heat conditions (e.g. ambient temperature up to 250° F.) and high moisture content (e.g. greater than 10%) to give a treated paper or paperboard. [col. 2, 11. 6-19]

and teaches that:

This invention provides treated paper and paperboard exhibiting superior resistance to both microwave soups and oils within two hours of drying. This unexpected behavior is most dramatic with pulp slurries containing a high level of post-consumer waste and/or fines, as these slurries typically are more difficult to treat than virgin fiber to achieve resistance to soups and oils. This invention gives an unexpected boost in water sizing performance compared to when the alkyl ketene dimer is used alone, especially in making molded pulp items such as microwave trays, take-out food trays and egg cartons. These items are made from very diverse furnish types (I.e. blends of softwood and hardwood fibers along with clay fillers and binders), may contain up to 100% recycled fiber, and are generally incompletely dried during the cure cycle. [col. 2, 11. 23-37]

Harrison et al. presents data purporting to show that:

. . . the fluoroalkyl monophosphate ester of Example 23 had excellent Soup Test and Oil Test result even when no heat cycle was employed. i.e. the treatment was allowed to cure at room temperature. In contrast, cured under the same ambient conditions, the fluorochemical paper treatments of Comparative Examples CI4-C 16 all had poor Soup Test results, and the alkyl ketene dimer (Hercon™ 76) used alone (Comparative Example C17) had poor Oil Test results. [col. 11, 11. 48-55]

This last teaching is generally in concert with the teaching in Kern, U.S. Pat. No. 5,308,441, that:

. . . synthetic sizing agents such as alkyl ketene dimer, stearic anhydride, and alkenyl succinic have been developed to form true chemical covalent bonds with cellulose rather than the ionic or polar bonds of natural size. Most prevalent of these synthetic size compounds is alkyl ketene dimer (AKD). Once cured, synthetic size is more stable against water, acids, and alkalis . . . [col. 1, 1. 65-col. 2, 1. 4]

England et al., U.S. Pat. No. 3,362,965, relates to beta-lactones of 3-hydroxy-4,4-bis(perfluoroalkyl)-3-butenoic acids and states that:

A few drops of the above β-lactone of Example I [β-lactone of 3-hydroxy-4,4-bis(trifluoromethyl)-3-butenoic acid] were placed on a filter paper, and the paper along with a control piece (nothing added) was warmed with hot air until it appeared dry. Both pieces of paper were then dipped into a beaker of water. It was immediately obvious where the added drops of lactone had reacted with the paper as only this portion was not saturated by the water even after several minutes soaking. When removed from the beaker, water drained from the treated portion of the paper which remained dry but the untreated paper was wet throughout. [col. 4, 11. 34-44]

Endres, European Patent Application 0144658, relates to:

. . . a tissue product comprising an internal porous barrier layer or ply of papermaking fibers coated with a water repellent agent [that] prevents or inhibits wetting of the user's hands during use and at the same time significantly improves the in-use strength of the product. [p. 1, 11. 29-34]

Endres teaches that:

. . . when a user blows his nose into a three-ply facial tissue of this invention having an inner layer comprising papermaking fibers coated with a water repellent agent, the nasal discharge will be absorbed by the outer ply touching the nose (the first outer ply), but will be inhibited from contacting the hands touching the other outer ply (the second outer ply) because the barrier layer retards fluid transmission. Therefore, by delaying or reducing the amount of moisture that reaches the second outer ply, the second outer ply retains much or all of its dry strength and therefore the tissue as a whole remains stronger in use. Hence the tissue will not fall apart in use as easily and the user's hands will be less likely to get wet. [p. 2, 11. 2-15]

. . .

The water repellent agents useful for purposes of this invention can be any chemical which will coat a cellulosic fiber and increase the wetting angle of aqueous fluids which contact the surface of the fiber. There are many types of such water repellent agents which can be used for this purpose and are well known in the chemical arts. Examples of water repellent types include: wax dispersions with or without aluminum or zirconium salts; metal salts and soaps; pyridinium repellents; waxy thermosetting resins; organometallic complexes of chromium and aluminum; silicones; fluorochemicals; and alkyl ketene dimers. Those skilled in the art will appreciate that the suitability of any specific water repellent agent will depend greatly on a wide variety of factors other than technical feasibility, such as economics, processing considerations, toxicity, etc.

In preparing the products of this invention, it is preferable that the water repellent agent be mixed with the paper-making fibers prior to formation of the web . . . [p. 3, 11. 2-21]

In any case, however, regardless of the manner in which the web is formed, the water repellent agents can be printed or sprayed onto the surface of a web to create a surface layer of water repellent fibers on the web. This can be advantageous for a two-ply product, for example, where the inner surface or surfaces of either or both plys can be coated with the water repellent agent to create the internal water repellent layer. In such a situation, however, care must be exercised not to allow the water-repellent agent to soak entirely through either of the plys and thereby detrimentally affect the absorbency and feel characteristics of the outer surface of the treated ply. Naturally this is more difficult to control with lower-basis weight webs as are commonly used for two-ply facial tissues. [p. 4, 11. 1-15]

The aforementioned references are incorporated herein in their entireties.

SUMMARY OF THE INVENTION

We have found that we can effectively incorporate reactive sizes into a tissue sheet by dissolving the size into substantially waterless emollient at elevated temperature, then applying the reactive size/emollient solution to the tissue by any of a wide variety of means including printing, spraying or applying from a roll. As long as the amount of water in the emollient is not so excessive as to seriously degrade the tissue as for example by collapsing the tissue structure, the tactile and aesthetic properties of the tissue can be preserved or possibly even enhanced.

More particularly, we have discovered that significant, but temporary hydrophobicity, can be imparted to tissue products by dissolving a reactive size chosen from ketene dimers and acid anhydrides in a substantially waterless emollient and applying a small amount at an elevated temperature to one face of the tissue by a mechanical contacting procedure including: spraying, roll application, gravure printing or any other convenient method. Typically, from about 0.2 to about 2.3 kg (0.5 to about 5 pounds) of reactive size per tonne (ton) of fiber will be sufficient to impart significant temporary hydrophobic properties to the sheet. Preferably, the amount of reactive size employed will be from about 0.5 to about 1.6 kg (1.0 to about 3.5 pounds) per tonne (ton) of fiber and more preferably will be between about 0.7 and 1.1 kg (1.5 and 2.5 pounds) per tonne (ton) of fiber. So long as the treated sheet is not cured at elevated temperature, the sheets exhibit temporary hydrophobic barrier properties but remain easily repulpable after treatment and flushable after use. Preferably the reactive size is either an alkyl ketene dimer or an alkenyl ketene dimer while the emollient is either a mineral oil or a polyhydroxy emollient such as propylene glycol. Most preferably, the reactive size is a ketene dimer.

Further details and aspects of the present invention are described in more detail below.

BRIEF DESCRIPTION OF THE DRAWINGS

The invention is described in detail below with reference to the drawing wherein like numbers designate similar parts and wherein:

The sole FIGURE is a schematic of a tissue forming operation.

DETAILED DESCRIPTION

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art.

The process of the present invention is particularly useful in applying reactive size, preferably a ketene dimer such as AKD to cellulosic webs with an open structure such as tissue or flushable non-wovens. Typically, when AKD is applied internally in the usual way from an aqueous emulsion, drying at high temperature is thought to fix the AKD to the cellulosic hydroxyl groups imparting permanent hydrophobic properties to the sheet. Without being bound by theory, it appears likely that when AKD is incorporated into a cellulosic sheet, significant sizing results merely from the presence of the AKD especially if it is spread in a thin film. It further appears likely that heating, as experienced in high temperature drying and possible oven curing, facilitates formation of a β-keto ester, rendering the reaction product difficult to extract even with THF. Thus, it appears that exposure to high temperature imparts relatively permanent hydrophobic properties to the sheet. It further appears that in those cases where the AKD bearing sheet is not exposed to high temperature, the AKD is extractable but that while the AKD remains, it provides some contribution to hydrophobic properties. See Bottorff, AKD Sizing Mechanism: A More Definitive Description, Tappi Journal Vol. 77, No. 4, April, 1994; pp. 105-116 and Isogai, Mechanism of Paper Sizing by Alkylketene Dimers, Journal Of Pulp And Paper Science: Vol. 25 No. 7 Jul. 1999, pp. 251-255.

Uncured cellulosic sheets treated with AKD/emollient admixture possess barrier properties which, although not permanent, are sufficiently long lived for many uses but do not have the detrimental effect of rendering the sheet non-dispersible. In the tissues and non-wovens of the present invention, spectroscopy (solid-state 13C NMR solid-state CP/MAS spectroscopy) indicates that: the β-lactone ring remains largely intact in the AKD applied to the web; no β-keto ester linkage is present; and therefore, the AKD is not covalently bound to the cellulose. In fact it appears that the vast bulk of the AKD applied in accordance with the present invention remains extractable using THF strongly indicating the absence of covalent bonding between the cellulose and AKD. It is however quite important that, in contrast to the usual case in which reactive size is applied from an aqueous emulsion, AKD forms a true solution in preferred emollients greatly facilitating intimate contact between AKD and the cellulosic fibers, obviating the need for high temperatures to effectively spread the AKD over the treated surface.

Suitable reactive sizes include;

ketene dimers having the general formula (I) below,

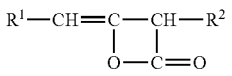

(I)

wherein $R^1$ and $R^2$ can be identical or different and represent saturated or unsaturated hydrocarbon groups, and acid anhydrides characterized by the general formula (II) below,

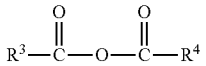

(II)

wherein $R^3$ and $R^4$ can be identical or different and represent saturated or unsaturated hydrocarbon groups, or $R^3$ and $R^4$ together with the —C—O—C-moiety can form a 5 to 6 membered ring, optionally being further substituted with hydrocarbon groups containing up to 30 carbon atoms.

Suitable ketene dimers may have as the hydrocarbon substituents: saturated hydrocarbons, the hydrocarbon groups suitably having from 8 to 36 carbon atoms, usually being straight or branched chain alkyl groups having 12 to 20 carbon atoms, such as decyl, hexadecyl and octadecyl groups, cycloalkyl groups having at least 6 carbon atoms, aralkyl groups and alkaryl groups. Suitable ketene dimers include octyl, decyl, dodecyl, tetradecyl, hexadecyl, octadecyl, eicosyl, docosyl, tetracosyl, phenyl, benzyl, beta-naphthyl and cyclohexyl ketene dimers, as well as the ketene dimers prepared from montanic acid, naphthenic acid, $\Delta^{9,10}$-decylenic acid, $\Delta^{9,10}$-dodecylenic acid, palmitoleic acid, oleic acid, ricinoleic acid, linolenic acid, and eleostearic acid, as well as ketene dimers prepared from naturally occurring mixtures of fatty acids, such as those mixtures found in coconut oil, babassu oil, palm kernel oil, palm oil, olive oil, peanut oil, rape oil, beef tallow, lard (leaf) and tall oil. Ketene dimers including alkyl, alkenyl, aryl, and alkaryl ketene dimers warrant particular mention as do 1,3,-cyclobutadione or unsaturated β-lactones. Suitable ketene dimers are sold by Hercules under the Trademark Aquapel.

Suitable acid anhydrides are preferably unsaturated hydrocarbon chains containing pendant succinic anhydride groups. Liquid succinic acid anhydride compounds, which are generally preferred in the processes and compositions of the present invention, may be derived from maleic anhydride and suitable olefins. Generally speaking, the succinic acid anhydride compounds may be made by contacting an olefin, preferably an excess of an internal olefin, with maleic anhydride, at a temperature and for a time sufficient to provide the desired acid anhydride compound.

Starting olefins that may be used in the preparation of the succinic acid anhydride compounds of the present invention may be linear or branched. Preferably, the olefins may contain from 8 to 30 carbon atoms, preferably at least about 14 carbon atoms. More preferably, the carbon length of olefins used in the preparation of the present succinic acid anhydrides compounds may range from about 14 carbon atoms to about 22 carbon atoms, and all combinations and subcombinations of ranges therein. Even more preferably, the succinic acid anhydrides compounds employed in the present methods and compositions may be prepared from olefins containing from about 16 to about 19 carbon atoms, with olefins containing from about 16 to about 18 carbon atoms being still more preferred. Succinic acid anhydride compounds that may be employed in the present methods and compositions may also be prepared, for example, by combining together maleic anhydride and blends of two or more olefins, such as blends of two or more of $C_{14}$, $C_{15}$, $C_{16}$, $C_{17}$, $C_{18}$, $C_{19}$, $C_{20}$, $C_{21}$, and $C_{22}$ olefins, or by separately preparing ASA compounds from maleic anhydride and, for example, $C_{14}$, $C_{15}$, $C_{16}$, $C_{17}$, $C_{18}$, $C_{19}$, $C_{20}$, $C_{21}$, and/or $C_{22}$ olefins, and blending together the separately prepared ASA compounds. Typical structures of ASA compounds are disclosed, for example, in U.S. Pat. No. 4,040,900, Mozzarella et al., the disclosure of which is hereby incorporated herein by reference, in its entirety.

Representative starting olefins that may be reacted with maleic anhydride to prepare succinic acid anhydride compounds for use in the present invention include, for example, tetradecene, pentadecene, hexadecene, heptadecene, octadecene, eicodecene, eicosene, heneicosene, docosene 2-n-hexyl-1-octene, 2-n-octyl-1-dodecene, 2-n-octyl-1-decene, 2-n-dodecyl-1-octene, 2-n-octyl-1-octene, 2-n-octyl-1-nonene, 2-n-hexyl-1-decene and 2-n-heptyl-1-octene. Preferred among these olefins are tetradecene, pentadecene, hexadecene, heptadecene, octadecene, eicodecene, eicosene, heneicosene and docosene. Other olefins that would be suitable for use in the preparation of succinic acid anhydride compounds for use in the present invention, in addition to those exemplified above, would be readily apparent to one of ordinary skill in the art, once armed with the teachings of the present application.

Examples of acid anhydrides which are used commercially include alkyl and alkenyl succinic anhydrides and particularly isoocta-decenyl succinic anhydride. Exemplary commercially available sizing agents of this type are Hercon 79 and Precis 3000 from Hercules, Inc., Wilmington, Del.

Suitable reactive sizes include AKD (either alkyl ketene dimer or alkenyl ketene dimer or combination thereof) and ASA (alkenyl succinic anhydride).

Suitable emollients are at most only slightly volatile and are preferably non-volatile and will largely remain on the surface of the tissue, transferring easily to the skin of the user where the emollient will provide a soothing, softening sensation. Preferably the vapor pressure of the emollient will be less than 0.1 mm Hg at 40° C., more preferably less than 0.01 mm Hg at 40° C. It is generally preferred that the emollient have a boiling point in excess of 150° C., more preferably in excess of 165° C. As highly inflammable solvents like tetrahydrofuran are not suitable, it is preferred that if the emollient is at all combustible, it have a flash point in excess of 65° C., more preferably in excess of 80° C., still more preferably in excess of 95° C. and most preferably in excess of 105° C.

Examples of classes of useful emollients include: hydrocarbon oils and waxes, such as mineral oil, petrolatum, paraffin, ceresin, ozokerite, microcrystalline wax, polyethylene, and perhydrosqualene; polyhydric alcohols and polyether derivatives, such as ethylene glycol, propylene glycol, diethylene glycol, dipropylene glycol, tripropylene glycol, butylenes glycol, hexylene glycol, polypropylene glycols 2000 and 4000, polyoxyethylene polyoxypropylene glycols, polyoxypropylene polyoxyethylene glycols, glycerol, sorbitol, ethoxylated sorbitol, hydroxypropylsorbitol, polyethylene glycols 200-6000, methoxy polyethylene glycols 350, 550, 750, 2000 and 5000, poly[ethylene oxide] homopolymers (100,000-5,000,000), polyalkylene glycols and derivatives, hexylene glycol (2-methyl-2,4-pentanediol), 1,3-butylene glycol, 1,2,6-hexanetriol, ethohexadiol USP (2-ethyl,3-hexanediol), C15-C18 vicinal glycol, and polyoxypropylene derivatives of trimethylolpropane; polydydric alcohol esters, such as ethylene glycol mono- and di-fatty acid esters, diethylene glycol mono- and di-fatty acid esters, polyethylene glycol (200-6000) mono- and di-fatty acid esters, propylene glycol mono- and di-fatty esters, polypropylene glycol 2000 monooleate, polypropylene glycol 2000 monostearate, ethoxylatedpropylene glycol monostearate, glyceryl mono- and di-fatty acid esters, polyglycerol poly-fatty acid esters, ethoxylated glyceryl monostearate, 1,3-butylene glycol-monostearate, 1,3-butylene glycol distearate, polyoxyethylene polyol fatty acid ester, sorbitan fatty acid esters, and polyoxyethylene sorbitan fatty acid esters; wax esters such as beeswax, spermaceti, myristyl myristate and stearyl stearate; beeswax derivatives, e.g., polyoxyethylene sorbitol beeswax; vegetable waxes including camauba and candelilla waxes; fatty alcohol ethers; ethoxylated fatty alcohols; fatty acids such as valeric, caproic, caprylic, pelargonic, capric, lauric, myristic, palmitic, stearic, isostearic, hydroxystearic, oleic, linoleic, ricinoleic, arachidic, behenic, and erucic acids; fatty alcohols such as lauryl, myristyl, cetyl, hexadecyl, stearyl, isostearyl, hydroxystearyl, oleyl, ricinoleyl, behenyl, and erucyl alcohols, as well as 2-octyl dodecanol; alkyl esters of fatty acids, including methyl, isopropyl, and butyl esters of fatty acids, alkyl esters including hexyl laurate, isohexyl laurate, iso-hexyl palmitate, isopropyl palmitate, decyl oleate, isodecyl oleate, hexadecyl stearate, decyl stearate, isopropyl isostearate, diisopropyl adipate, dissohexyl adipate, di-hexyldecyl adipate, di-isopropyl sebacate, lauryl lactate, myristyl lactate, and cetyl lactate; alkenyl esters of fatty acids, such as oleyl myristate, oleyl stearate, and oleyl oleate; ether-esters, such as fatty acid esters of ethoxylated fatty alcohols; ethoxylated glycerides, such as ethoxylated glycerylmonostearate; glyceride esters, such as acetylated monoglycerides, acetylated lard glycerides, acetylated palm kernel glycerides, hydrogenated palm kernel glycerides, hydrogenated tallow glycerides, hydrogenated vegetable glycerides, hydroxylated milk glycerides, PEG-6 capric/caprylic glycerides, oleic/palmitoleic/linoleic glycerides, PEG-12 dioleate, P. palm kernel glycerides, PEG-60 shea butter glycerides, PEG-70 mango glycerides, PEG-75 lanolin, P. shea butter glyceriders and PEG-75 shorea butter glycerides; triglyceride esters, such as caprylic/capric triglyceride, caprylic/capric triglyceride PEG-4 ester, caprylic/capric/lauric triglyceride, caprylic/capric/linoleic triglyceride, caprylic/capric/oleic triglyceride, caprylic/capric/stearic triglyceride, caprylic/capric/succinic triglyceride, lauric/palmitic/oleic triglyceride, vegetable and animal fats and oils including castor oil, safflower oil, cotton seed oil, corn oil, olive oil, cod liver oil, almond oil, avocado oil, palm oil, sesame oil, and soybean oil; silicone oil, such as dimethyl polysiloxanes, methylphenyl polysiloxanes, dimethicone, dimethicone copolyol, dimethicone copolyol acetate, dimethicone copolyol isostearate, dimethicone methyl ether, dimethicone copolyol phthalate, dimethicone propylethylenediamine behenate, dimethiconol stearate, phenethyl dimethicone, cyclomethicone and water-soluble and alcohol-soluble silicone glycol copolymers and phospholipids, such as lecithin and derivatives; sterols including, for example, cholesterol and cholesterol fatty acid esters; amides such as fatty acid amides, ethoxylated fatty acid amides and solid fatty acid alkanolamides as well as mixtures, admixtures and combinations of any of the foregoing.

Examples of suitable emollient mixtures include lanolin and its derivatives such as that following: lanolin, lanolin oil, lanolin wax, lanolin grease, lanolin alcohols, lanolin fatty acids, isopropyllanolate, ethoxylated lanolin, ethoxylated lanolin alcohols, ethoxolated lanolin, propoxylated lanolin alcohols, acetylated lanolin, acetylated lanolin alcohols, lanolin alcohols linoleate, lanolin alcohols recinoleate, acetate of lanolin alcohols recinoleate, acetate of lanolin alcohols recinoleate, acetate of ethoxylated alcohols esters, hydrogenolysis of lanolin, ethoxylated hydrogenated lanolin, ethoxylated sorbitol lanolin, and liquid and semisolid lanolin absorption bases.

Particularly useful emollients include: mineral oil; propylene glycol; acetylated monoglycerides; caprylic, pelargonic and capric acid; caprylic/capric triglyceride and caprylic/capric/oleic triglyceride; dimethicone copolyol and cyclomethicone.

Typically, the amount of ketene dimer and or acid anhydride dissolved or dispersed in the emollients should be from about 1 to about 25% by weight, preferably from about 2 to about 20%, more preferably from about 5 to about 15% by weight and most preferably from about 8 to 12% by weight. The total amount of emollient applied to the sheet should be no more than about 27.2 kg (60 pounds) of emollient per tonne (ton) of fiber, preferably less than about 22.7 kg (50 pounds), more preferably between about 2.3 and 18.1 kg (5 and 40 pounds) per tonne (ton) and most preferably between about 4.5 and 13.6 kg (10 and 30 pounds) per tonne (ton). The preferred admixtures of reactive size and emollient will be substantially waterless, however small amounts of water can be tolerated as not unduly degrading the sheet so long as the total amount of water applied to the sheet is less than about 15% of the weight of the sheet, preferably less than about 7%. Preferably, the amount of water in the reactive size/emollient admixture will be less than about 5% by weight, more preferably, less than about 3% by weight and still more preferably less than about 2%.

For most of the reactive sizes and emollients contemplated, it will be sufficient to heat the emollient to between 55° C. and 110° C., most commonly to about 55° C. to 70° C. to achieve complete dissolution of the reactive size into the emollient. As most of the acid anhydrides suitable for sizing are liquid at room temperature, it is not always necessary to heat either the emollient or the acid anhydride to achieve complete solution. Although it is not strictly necessary to heat the emollient to dissolve suitable ketene dimers in the emollient, it is greatly advantageous to apply the emollient ketene dimer solution to the sheet at a temperature between 55° C. and 110° C., most commonly to about 55° C. to 70° C. Accordingly, it will usually be most advantageous to mix the emollient and size shortly before application to avoid heating the solution twice, so both are advantageously heated at the time of mixing. If the ketene dimer and emollient are not mixed shortly prior to application, it will usually be preferable to at least heat the ketene dimer to facilitate solution in the emollient. After the ketene dimer is dissolved in the emollient, the solution can be stored at room temperature without incurring an undesirable phase separation. In most cases, particularly when both emollient and ketene dimer are heated, little or no agitation is required to prepare a satisfactory admixture, which, without being bound by theory, is believed to be a true solution of reactive size in emollient, for application to the sheet.

The present invention is suitable for utilization in all classes of absorbent or tissue papers, including facial tissue, bath tissue, napkins, toweling and wipers. It is particularly useful in connection with bath and facial tissue products where temporary extra protection from wet-through may be considered especially desirable. By their very nature as disposable items, long term hydrophobic properties are not only unnecessary but are usually detrimental.

By absorbent paper or tissue, we mean tissue having significant void volume or bulk as opposed to flat paper or paperboard where are generally quite dense and relatively void free. It is a very important advantage of the present invention that it is possible to impart temporary barrier properties to previously formed tissue products without unduly degrading the bulk or void volume of that tissue and without seriously impairing the flushability of the products. In many cases, especially in older houses with mature trees, the root system of trees often invades the plumbing system, with the result that these plumbing systems are susceptible to clogging if tissues flushed through the system do not disintegrate after prolonged exposure to moisture. When in contact with water, tissues treated in accordance with the present invention lose their hydrophobic barrier properties over time and so are acceptable for flushing. Similarly, there has been great interest in flushable non-wovens.

There are several ways in which absorbent papers may be distinguished from flat paper, particularly density and bulk. For the purposes of the present invention, it is preferred that the density of the sheets is below about 0.6 g/cc, more preferably below about 0.30 g/cc. More specifically, it is preferred that the density is between about 0.04 g/cc and about 0.20 g/cc. The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 15.5 g/cm$^2$ (95 g/in$^2$). Typically about 8 sheets of tissue will be stacked, the total thickness determined, and the average caliper determined by dividing by 8. Alternatively, the tissue and towel products of the present invention will have a bulk of about 2 cm$^3$/g or greater, more specifically about 2.5 cm$^3$/g or greater, and still more specifically about 3 cm$^3$/g or greater.

The method of the present invention may be applied either during the tissue manufacturing process or in the converting process. It can be applied in processes using conventional wet pressing technology, through drying technology and uncreped through dry technology. Significantly, no additional drying capacity is needed, no matter where this process is incorporated into the tissue making process while the tactile properties and open porous structure of the sheet are not substantially degraded by the process. Flushable cellulose containing non-wovens may also be treated in accord with the present invention. Such non-wovens are known from U.S. Pat. No. 7,776,772, Barnholtz et al.; U.S. Pat. No. 7,772,138, Lostocco et al.; U.S. Pat. No. 7,666,448, Mower; U.S. Pat. No. 7,605,096, Tomarchio et al.; U.S. Pat. No. 7,592,049, Jones et al.; U.S. Pat. No. 7,276,459, Lang et al.; U.S. Pat. No. 6,087,550, Anderson-Fischer et al.; U.S. Pat. No. 5,630,972, Patnode et al.; U.S. Pat. No. 5,300,358, Evers; U.S. Pat. No. 5,256,417, Koltisko; U.S. Pat. No. 4,755,421, Manning et al.; and U.S. Pat. No. 4,362,781, Anderson.

The reactive size/emollient admixture may be applied to the sheet by any of a variety of mechanical/physical methods including printing and spraying. As many ketene dimer and AKD compositions are solid or at least not easily flowable at room temperature (or mill temperature which often varies considerably from 23° C.), it is generally preferred to apply ketene dimer and AKD containing admixtures by methods chosen to minimize the amount of admixture which ends up elsewhere than on the sheet as in many cases it will need to be removed mechanically. Gravure printing is one particularly suitable method of applying precisely controlled amounts of reactive size/emollient admixture to the sheet. Similarly, a commercially available Dynatec printer discussed herein after is quite effective in controlling overspray.

Most of the commercially popular succinic acid anhydride compositions are liquid at room temperature, so succinic anhydride/emollient admixtures may be applied by either spraying or printing. When admixtures are applied to a dry or nearly dry sheet by spraying, it is generally advisable to control the drop size with droplets generally being less than about 250 μm. It is thought to be particularly advantageous to avoid exposing alkenyl succinic anhydride to water prior to contacting the sheet to avoid undesirable hydrolysis of the anhydride.

Spray application of the reactive size/emollient according to the present invention is preferably carried out at an average droplet size of not greater than 200 μm. More preferably, the treating agent is applied in an average droplet size of not more than 100 μm, still more preferably in an average droplet size of from about 20 to about 70 μm. In one preferred embodiment, the treating agent is applied in an average droplet size of not greater than about 50 μm. In still another embodiment, the treating agent is applied in an average droplet size of not greater than about 25 μm. The application of the treating agent in this manner addresses the undesirability of rewet of the fibrous web and thus ameliorates the need for the application of heat or any additional drying of the web as well as forestalling the possibility of undue degradation of the open structure of the tissue product by contact with substantial amounts of water.

The treating agent may be applied by any delivery apparatus which can maintain the required average droplet size or where droplet size can be controlled. Appropriate applicators include, but are not limited to, hydraulic nozzles, atomized nozzles and electrostatic applicators.

In a preferred embodiment of the present invention, the treating agent is applied by a rotary dampening system. Such a rotary dampening system is available from WEKO. In this system, a treating agent is applied by means of special spraying discs called rotors that are aligned and are designed to spin. In the process of spinning, these discs throw the treating agent onto the passing web. Each rotor has a certain spray area and the rotors are aligned side by side in a rotor carrier. The spraying width of the individual rotors is fixed by a diaphragm on the rotor carrier so that the fans of the spray are contiguous, ensuring a uniform application over the entire width of the material. The treating agent can be applied uniformly or in a pattern on the web; however, the treating agent is preferably applied uniformly across the web.

The most preferred applicator is an ITW Dynatec Equity UFD with 1 to 6 nozzles per 2.5 cm (inch) which uses very low air pressure greatly ameliorating issues with overspray.

Where application of the reactive size/emollient is to be made by printing, use of a gravure roll in accordance with well known technology is preferred to facilitate precise control of the amount of reactive size/emollient applied as well as its location.

In many cases, it will be convenient to contact the sheet with the ketene dimer/emollient admixture between the Yankee or final dryer and the reel. However, it is not necessary to heat or cure the ketene dimer bearing sheet in order to impart significant hydrophobicity to the treated side of the sheet; and, in fact, such curing will have the effect of making the barrier properties of the sheet excessively long lasting thus potentially interfering with flushing of treated sheet or repulping of broke. Accordingly, in the preferred practice of the present invention, the sheets are not cured after the emollient/reactive size admixture has been applied and thus retain the ability to be dispersed in water. Rather in preferred embodiments of the present invention, the reactive size is not bound to the cellulosic fibers in the sheet. Determination whether AKD applied to the sheet has reacted with the sheet or remains unbound can be determined using techniques discussed in Bottorff, AKD Sizing Mechanism: A More Definitive Description, Tappi Journal Vol. 77, No. 4, April, 1994; pp. 105-116. Even though it might be considered somewhat paradoxical to apply a reactive size but apply it under conditions forestalling, if not entirely preventing, reaction between the reactive size and the substrate, that it is the intent of the present invention.

The sole FIGURE is a schematic of a tissue forming operation in which tissue sheet 20 on a carrier fabric 22 such as a felt or throughdrying fabric is passed over transfer roll 24 and adhered to Yankee Cylinder 26 surrounded by hood halves 28 and 30. (Transfer roll 24 may either be a suction pressure roll in the case of a conventional wet press operation or it may be a simple transfer roll in the case that the upstream operation (not shown) is set up for throughdrying.) Tissue sheet 20 is creped from Yankee Cylinder 26 at crepe blade 32 then passes through printing station 34 and between spray nozzles 36 and 38 before being accumulated on reel 40. As shown in the sole FIGURE, printing station 34 comprises upper print section 42 and lower print section 44 although either could be used separately without the other. Similarly, either or both nozzles 36 and 38 could be deployed as it is not necessary to use both. Although an operation might include both nozzles 36 and 38 and both upper print section 42 and lower print section 44, in most cases, something less than the full panoply of printing equipment depicted would be used, with only one being the most usual choice.

In upper print section 42, nozzle 46 sprays emollient/reactive size admixture onto print roll 48 which contacts sheet 20 and applies a controlled amount of reactive size/emollient admixture to sheet 20 while housing 50 protects the sheet from overspray, dripping and the like. In lower print section 44, reactive size/emollient admixture 52 is retained in reservoir 54 contacting inking roll 56 which transfers reactive size/emollient admixture to gravure roll 58 contacting sheet 20. Either or both of nozzle 36 and nozzle 38 sprays reactive size/emollient admixture 52 onto sheet 20.

EXAMPLE

Alkenyl ketene dimer (Basoplast® brand supplied by BASF) is dissolved in Carnation mineral oil in an amount of 10% by weight. The admixture is heated to 45° C. and sprayed onto a previously formed tissue sheet in such an amount that 0.9 kg (2 pounds) of AKD are applied per tonne (ton) of tissue. A first portion of the resulting tissue is then tested at 10, 40 and 70 seconds after the first contact between the sheet and the water to evaluate the water contact angle of droplets applied to either surface of the sheet—without any intervening process. A second portion of the resulting tissue is then "cured" in an oven at 105° C.

Surprisingly, it was found that curing at elevated temperature is not required to impart significant barrier properties with the "uncured" sheet possessing significant hydrophobicity, particularly on the surface to which the AKD emollient mixture was applied. Equivalent results were obtained when the procedure was repeated using propylene glycol as the emollient in varying amounts, as detailed in the Table below. In each case, the open porous structure of the tissue sheet was substantially preserved.

| Carrier/Cure | kg/tonne (pounds/ton) of AKD | Side | Contact Angle (Water) Elapsed Time 10 sec. | 40 sec | 70 sec. |
|---|---|---|---|---|---|
| Mineral | 0.9 | treated | 98° | 82° | 76° |
| Oil/ambient | (2) | opposite | 87° | 71° | 63° |
| Mineral oil/ | 0.9 | treated | 114° | 112° | 111° |
| oven | (2) | opposite | 121° | 120° | 120° |
| Propylene | 0.9 | treated | 125° | 124° | 122° |
| Glycol/ambient | (2) | opposite | 106° | 101° | 98° |
| Propylene | 0.7 | Treated | 128° | 127° | 126° |
| glycol/oven | (1.6) | opposite | 128° | 127° | 126° |

It is considered quite significant that such high contact angles can be achieved without any curing of the sheet and that the contact angle decreases at a rate which is slow enough to provide barrier properties within the brief period after the sheet first contacts water but rapid enough that the sheet becomes dispersible within 5 hours after immersion in water. It is particularly beneficial that the untreated side is less hydrophobic than the treated side thus providing an entrée for water which, after immersion will ultimately disperse the fibers in the sheet.

While the invention has been described in connection with numerous examples, modifications to those examples within the spirit and scope of the invention will be readily apparent to those of skill in the art. In view of the foregoing discussion, relevant knowledge in the art and references including co-pending applications discussed above, the disclosures of which are all incorporated herein by reference, further description is deemed unnecessary.

What is claimed is:

1. A method of making a wet laid cellulosic tissue sheet having fugitive water barrier properties comprising:

forming a wet laid cellulosic tissue sheet comprising cellulose fibers and applying to the wet laid cellulosic tissue sheet from about 5 to about 60 pounds of an emollient per ton of fiber and from about 0.5 to about 5 pounds of a reactive size per ton of fiber, admixed together in a substantially non-aqueous solution comprising less than about 5% water by weight of the solution, to form a wet laid cellulosic tissue sheet having fugitive water barrier properties, wherein said reactive size is soluble in said emollient at a temperature of less than 110° C.

2. The method of claim 1, wherein the wet laid cellulosic tissue sheet is not cured at an elevated temperature following the application of the substantially nonaqueous solution of emollient and reactive size.

3. The method of claim 2, wherein the wet laid cellulosic tissue sheet is dried by application of elevated temperatures prior to application of the solution of emollient and reactive size, and is not further dried by application of elevated temperatures after application of the solution of emollient and reactive size.

4. The method of claim 2, wherein the reactive size is chosen from at least one of:

i. ketene dimers having the general formula:

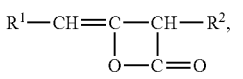

wherein $R^1$ and $R^2$ represent saturated or unsaturated hydrocarbon groups having from 8 to 36 carbon atoms; and ii. acid anhydrides having the general formula:

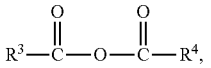

wherein $R^3$ and $R^4$ can be identical or different and represent saturated or unsaturated hydrocarbon groups suitably containing from 8 to 30 carbon atoms, and $R^3$and $R^4$ together with the —C—O—C—moiety can form a 5 to 6 membered ring, optionally being further substituted with hydrocarbon groups containing up to 30 carbon atoms;

and mixtures thereof.

5. The method of claim 2, wherein the reactive size is at least one ketene dimer chosen from alkyl ketene dimers, alkenyl ketene dimers, aryl ketene dimers, alkaryl ketene dimers, and mixtures thereof.

6. The method of claim 5, wherein the ketene dimer in the wet laid cellulosic tissue sheet having fugitive water barrier properties comprises an intact β-lactone structure.

7. The method of claim 2, wherein the reactive size is chosen from at least one of alkenyl ketene dimers and alkenyl succinic anhydrides.

8. The method of claim 2, wherein the reactive size is chosen from at least one of isoocta-decenyl succinic anhydride, 1,3-cyclobutadione, and an unsaturated β-lactone.

9. The method of claim 2, wherein the emollient is chosen from at least one of a mineral oil, propylene glycol, acetylated monoglycerides, caprylic acid, pelargonic acid, capric acid, caprylic/capric triglyceride, caprylic/capric/oleic triglyceride, dimethicone copolyol, cyclomethicone, and mixtures thereof.

10. The method of claim 9, wherein the emollient is chosen from at least one of a mineral oil or propylene glycol.

11. The method of claim 2, wherein the reactive size is chosen from at least one of alkenyl ketene dimers and alkenyl succinic anhydrides and wherein the emollient is chosen from at least one of a mineral oil or propylene glycol.

12. The method of claim 2, wherein the amount of reactive size admixed with the emollient is from about 1 to about 25% by weight of the total weight of the solution of emollient and reactive size.

13. The method of claim 2, wherein the amount of reactive size admixed with the emollient is from about 2 to about 20% by weight of the total weight of the solution of emollient and reactive size.

14. The method of claim 2, wherein the amount of reactive size admixed with the emollient is from about 5 to about 15% by weight of the total weight of the solution of emollient and reactive size.

15. The method of claim 2, wherein the amount of reactive size admixed with the emollient is from about 8 to 12% by weight of the total weight of the solution of emollient and reactive size.

16. The method of claim 2, wherein the emollient is heated to between about 55 to 110° C. before being admixed with the reactive size.

17. The method of claim 2, wherein the temperature of the solution of emollient and reactive size is between about 55° C. to 80° C. when applied to the cellulosic tissue sheet.

18. The method of claim 2, wherein the amount of reactive size is from about 1.0 to about 3.5 pounds per ton of fiber.

19. The method of claim 2, wherein the amount of reactive size is from about 1.5 to about 2.5 pounds per ton of fiber.

20. The method of claim 2, wherein at least about 99.9% by weight of the reactive size in the wet laid cellulosic tissue sheet having fugitive water barrier properties is extractible using THF.

21. The method of claim 2, wherein the water contact angle on one side of the wet laid cellulosic tissue sheet having fugitive water barrier properties exceeds 90° at 10 seconds after contact with water but decreases to less than 85° within 5 minutes after contact with water.

22. A method of making a wet laid cellulosic tissue sheet having fugitive water barrier properties comprising:

forming a wet laid cellulosic tissue sheet comprising cellulose fibers and applying to the wet laid cellulosic tissue sheet from about 5 to about 60 pounds per ton of fiber of an emollient chosen from at least one of a mineral oil or propylene glycol, and from about 0.5 to about 5 pounds of a reactive size per ton of fiber chosen from at least one of alkenyl ketene dimers and alkenyl succinic anhydrides, admixed together in a substantially nonaqueous solution comprising less than about 5% water by weight of the solution, to form a wet laid cellulosic tissue sheet having fugitive water barrier properties, wherein the amount of reactive size admixed with the emollient is from about 2 to about 20% by weight of the total weight of the solution of emollient and reactive size, wherein said reactive size is soluble in said emollient at a temperature of less than 110° C., wherein the temperature of the solution of emollient and reactive size is between about 55° C. to 80° C. when applied to the wet laid cellulosic tissue sheet, wherein the wet laid cellulosic tissue sheet is not cured at an elevated temperature following the application of the substantially nonaqueous solution of emollient and reactive size, and wherein the wet laid cellulosic tissue sheet is dried by application of elevated temperatures prior to application of the solution of emollient and reactive size, and is not further dried by application of elevated temperatures after application of the solution of emollient and reactive size.

* * * * *